United States Patent [19]

Bönnighausen

[11] 4,391,070

[45] Jul. 5, 1983

[54] CHIMNEY

[75] Inventor: Manfred Bönnighausen, Bochum, Fed. Rep. of Germany

[73] Assignee: Babcock-Bau GmbH, Oberhausen, Fed. Rep. of Germany

[21] Appl. No.: 239,116

[22] Filed: Feb. 27, 1981

[30] Foreign Application Priority Data

Feb. 29, 1980 [DE] Fed. Rep. of Germany ..... 3007719

[51] Int. Cl.[3] ..... E04H 12/28; F23J 13/02; E04B 1/35

[52] U.S. Cl. ..... 52/127.2; 52/125.1; 52/218; 52/745

[58] Field of Search ..... 52/127.2, 173 R, 218, 52/236.3, 125.1, 741, 745, 245, 244, 236.6

[56] References Cited

U.S. PATENT DOCUMENTS

| | | | |
|---|---|---|---|
| 2,964,143 | 12/1960 | Fayeton | 52/125.1 X |
| 3,363,393 | 1/1968 | Von Heidenstam | 52/745 |
| 3,490,191 | 1/1970 | Ekblom | 52/125.1 X |
| 3,535,841 | 10/1970 | Lorenz et al. | 52/236.6 |
| 3,713,265 | 1/1973 | Wysocki et al. | 52/745 |
| 3,761,551 | 9/1973 | Ogata et al. | 52/245 X |
| 3,921,362 | 11/1975 | Cortina | 52/745 |
| 4,068,419 | 1/1978 | Decoppet | 52/127.2 |
| 4,302,915 | 12/1981 | Stocks | 52/236.3 |

FOREIGN PATENT DOCUMENTS

| | | | |
|---|---|---|---|
| 2250360 | 5/1975 | France | 52/218 |

*Primary Examiner*—J. Karl Bell
*Attorney, Agent, or Firm*—Max Fogiel

[57] ABSTRACT

A chimney construction arrangement in which the load-bearing external trunk is built in sliding or climbing shuttering and supports platforms with support arms for accommodating the flue gas pipe or the flue gas pipes. Support elements are formed on the inner wall of the external trunk at the planned levels of the platforms. The platforms are built completely within the external trunk at ground level and raised to respective levels with lifting equipment. The platforms are connected with the support elements. The support elements may be individual brackets. A plurality of platforms may be raised as a group and individually attached to the support elements.

5 Claims, 5 Drawing Figures

Fig. 2
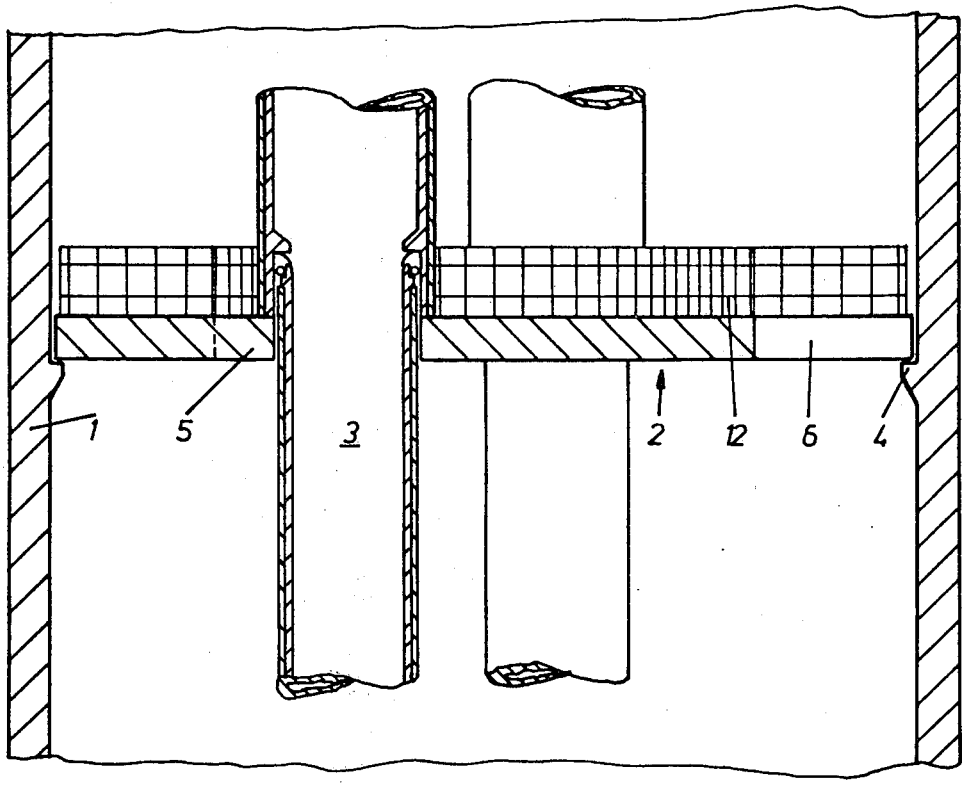
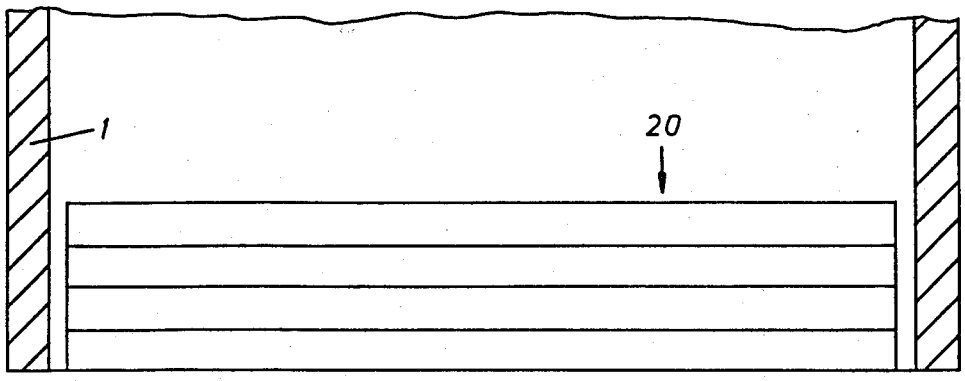
Fig. 2a

CHIMNEY

BACKGROUND OF THE INVENTION

The present invention relates to a chimney as well as to a method for constructing such a chimney. The load-bearing external truck of the chimney is built in sliding or climbing shuttering arrangement and supports platforms which are provided with support arms and serve for accommodating the flue gas pipe or flue gas pipes.

DE-OS 19 27 446 (German patent application laid open to public inspection before examination) discloses a method of this kind, under which the platforms are assembled at the respective platform level and are supported in recesses of the external trunk. This method requires a relatively time-consuming erection at large heights.

The present invention puruses the object of providing a chimney and a chimney erection method which allows the platforms to be installed within a shorter time and with less danger.

Another object of the present invention is to provide a chimney arrangement of the foregoing character which is substantially simple in construction and may be economically fabricated.

A further object of the present invention is to provide a chimney erection method and chimney, as described, which may be readily maintained in service and has a substantially long useful life.

SUMMARY OF THE INVENTION

According to the present invention the objects are achieved by forming support elements on the inner wall of the external truck at the planned levels of the platforms, by constructing the platforms completely within the external trunk at ground level, by raising them to the respective levels with the aid of a lifting equipment, and by connecting them with the support elements.

In an advantageous configuration, the support elements are constructed as individual brackets. Each platform passes by the brackets when being raised to the respective level. The hanging platform becomes turned so as to locate its support arms above the brackets, and the platform is then lowered onto the brackets.

By complete construction of the platforms at ground level, this method allows the chimney construction time to be shortened substantially. Also, construction of the platforms themselves can be carried out at more favorable costs as well as with greater dimensional accuracy. Personnel which is not free from giddiness and which has no practice in climbing chimneys may also be employed for constructing the platforms, while simultaneously it is possible to decrease accident hazards.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2*a* is a part of a section II—II through FIG. 1 and shows a method for building platforms in superposition;

FIG. 2 is a section II—II through FIG. 1;

DESCRIPTION OF THE PREFERRED EMBODIMENTS

Figure 1:
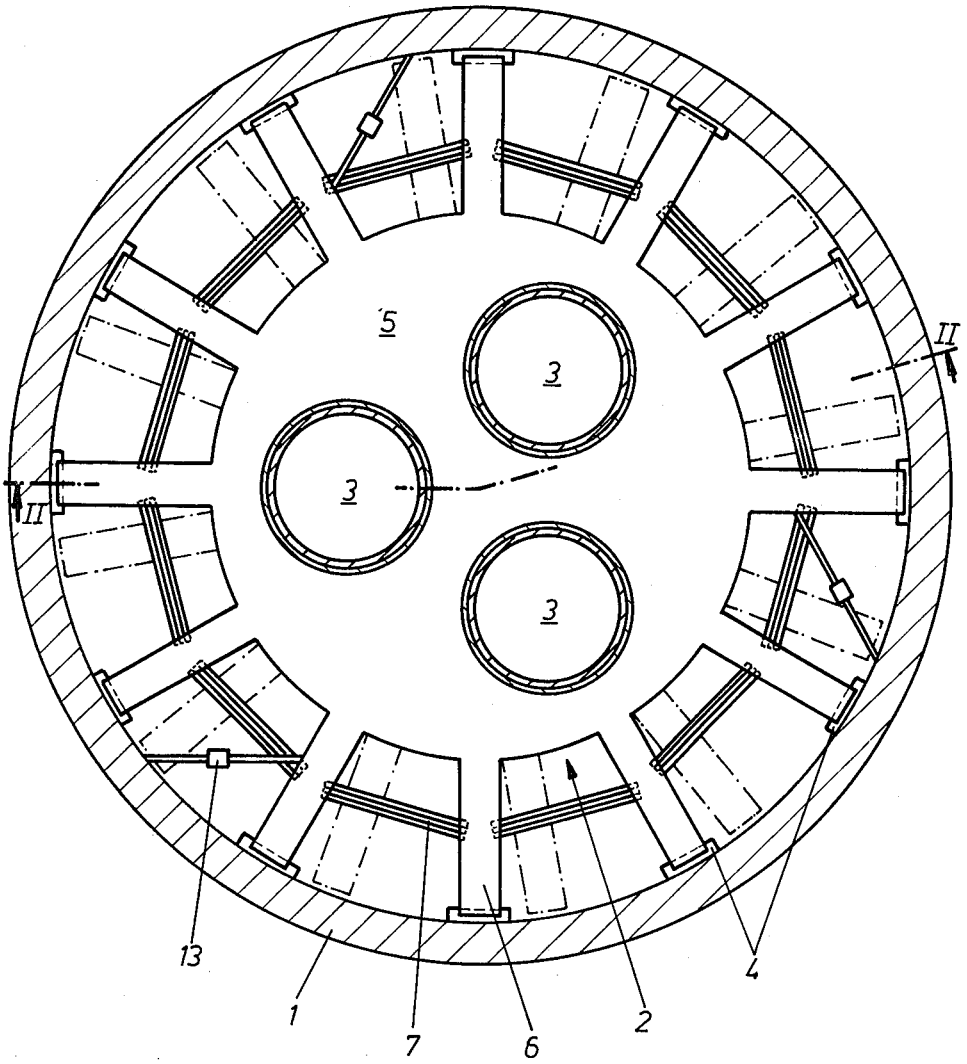
FIG. 1 is a plan view of a platform.
Figure 3:
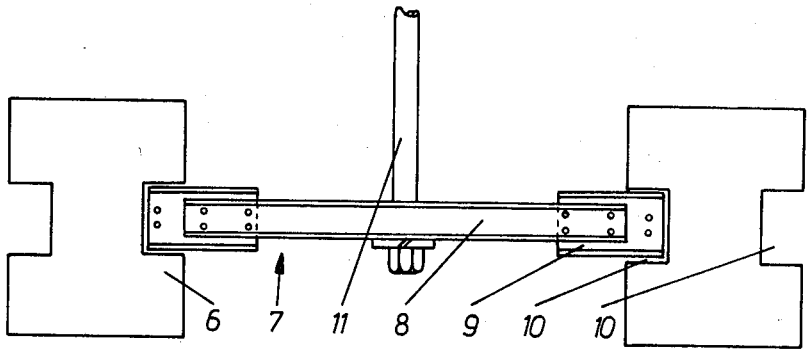
FIG. 3 shows an erection beam.

The chimney consists of a load-bearing external trunk 1 in which platforms 2 are supported at different levels. In the present case, platforms 2 support the brickwork of three flue gas pipes 3.

The external trunk 1 is constructed by means of sliding or climbing shuttering in the manner known in the art. Support elements projecting into the inner space of the external trunk 1 are simultaneously formed on the inner wall of the external trunk 1 at the level of the platforms to be installed. The support elements are constituted by individual brackets 4 which are spaced from each other.

Each platform 2 consists of the internal core 5 which has a circular cross-section. Support arms 6, resting on the brackets 4 in the finish-mounted condition, are formed on core 5. The cores 5 of the platforms 2 have all the same diameter. The different radial expansion between core 5 of platforms 2 and the external trunk 1 tapering upwardly is made up by an adapted length of the support arms 6. The free cross-section within the external trunk 1 serves for longitudinal ventilation of the chimney and is practicable.

Like the load-bearing external trunk 1, the platforms 2 consist of reinforced concrete and are built within the internal space of the external trunk 1 at ground level. The individual platforms 2 are constructed in superposition within a shuttering. Platform 2 which will first be loaded by the brickwork upon bricking up the flue gas pipes 3, will thus be built first. This extension of the curing time will provide this platform 2 with sufficient strength.

Two adjacent support arms 6 each are connected by removable erection beams 7. The erection beams 7 consist of two channel sections 8 which are opposed to each other with their flanges. The ends of the channel sections 8 engage a short section of a T beam 9 and are connected with it in a detachable manner. The T beam 9 extends into a recess 10 which is provided for in each support arm 6 during construction of the platforms 2. When the erection beams 7 have performed their function, the connection between the channel sections 8 and the T beams 9 will be broken and the T beam 9 will be pushed between the channel sections 8. In this way it is possible to remove the erection beams 7 from one platform 2 and to introduce them into the next one.

The ropes of a lifting equipment penetrate between the channel sections 8 of the erection beams 7 and are anchored to the underside of the erection beams 7. The lifting equipment consists of several winches installed on the uppermost platform of the chimney. This uppermost platform will be built in situ upon establishing the external trunk.

The completed platforms 2 will be provided with the necessary super-structures, e.g. handrail 12 as a protection from tumbling down and removable working platforms. This will be raised to the desired height by the lifting equipment either individually or as a group. During the lifting operation the platforms 2 will be aligned within the external trunk so that the support arms 6 will laterally pass by the brackets 4. This position of the support arms 6 is intimated in FIG. 1 by the dash-dotted lines. When platform 2 is at the desired height, it will be turned, while still being hung up, so much as to locate the support arms 6 above the brackets 4. The turning motion will be caused by three positioners 13 staggered by 120° each. The positioners 13 consist of a puller which is connected with the respective platform 2 and the external trunk 1 in a detachable manner. They will be operated manually from the removable working platforms connected with the support arms 6.

When the platform 2 is aligned above the brackets 4, it will be lowered. The seat of bracket 4 consists of a steel plate and an elastomeric bearing. After touchdown, the steel plates of the brackets 4 will be grouted with a shrinkage-free mortar which is able to support the dead weight of platform 2 after four hours at the latest.

Figure 4:
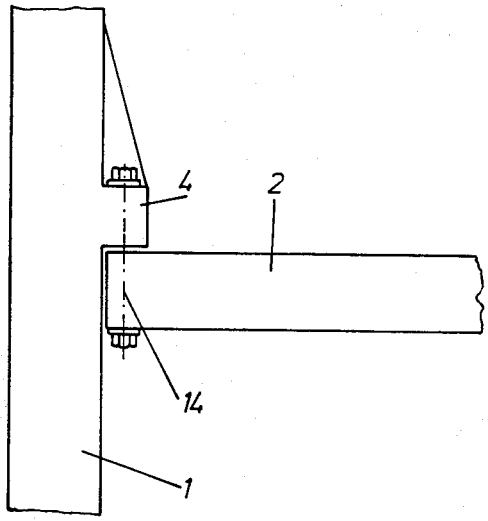
FIG. 4 shows a platform attachment.

The inventive method may be applied also when the support arms 6 of platforms 2 do not rest on the brackets 4, but, as represented in FIG. 4, are pulled below the bracket 4 and are attached there by means of a tie bolt 14. As the external trunk 1 is slightly tapered, it is possible in this case to give the platform 2 external dimensions which are so large that each platform 2 may just pass by the brackets 4 arranged at lower levels. In this way it is possible to desist from turning the platform 2.

The platforms can also be built in superposition within the external trunk by using a shuttering 20 shown in FIG. 2*a*.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Method for constructing a chimney having a load-bearing external trunk which is built in sliding or climbing shuttering and supports platforms for accommodating flue gas pipe or flue gas pipes, comprising the steps: forming support elements on the inner wall of the external trunk at planned levels of the platforms; constructing said support elements as individual brackets; providing the platforms with support arms; building the platforms with support arms completely within the external trunk at ground level; raising the platforms to respective levels with lifting equipment; passing each platform by the brackets when being raised to a respective level; turning the hanging platform by an amount so as to locate its support arms above the brackets; and then lowering the platform with supporting arms onto the brackets, said platforms and support elements being prefabricated.

2. Method according to claim 1, wherein a plurality of platforms are raised as a group and are individually attached to the support elements.

3. Method according to claim 1, wherein the platforms are built in superposition within the external trunk by using a shuttering.

4. Chimney comprising: a load-bearing external trunk and a plurality of platforms accommodating the brickwork of flue gas pipe means; said platforms having support arms resting on support elements of said external trunk; said support arms resting on said support elements; said support elements comprising individual brackets; and positioner means acting in horizontal direction between said external trunk and at least one of said support arms, said support elements being formed on the inner wall of the external trunk at planned levels of the platforms, said platforms with support arms being built completely within the external trunk at ground level, each platform passing by the brackets when being raised to a respective level, a hanging platform being turned by an amount so as to locate its support arms above the brackets and then lowered onto the brackets, said platforms and support elements being prefabricated.

5. Chimney according to claim 4, including removable erection beams for lifting equipment and connected with said support arms.

* * * * *